US008455774B2

(12) United States Patent
Kato

(10) Patent No.: US 8,455,774 B2
(45) Date of Patent: Jun. 4, 2013

(54) ELECTRONIC APPARATUS

(75) Inventor: Shuichi Kato, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 241 days.

(21) Appl. No.: 12/972,331

(22) Filed: Dec. 17, 2010

(65) Prior Publication Data

US 2011/0147188 A1 Jun. 23, 2011

(30) Foreign Application Priority Data

Dec. 22, 2009 (JP) ..... 2009-291468

(51) Int. Cl.
*H01H 9/26* (2006.01)

(52) U.S. Cl.
USPC ..... 200/5 A

(58) Field of Classification Search
USPC ..... 200/5 A, 5 R, 18, 50.33, 50.36, 512, 200/513, 520, 341
See application file for complete search history.

(56) References Cited

U.S. PATENT DOCUMENTS

| | | | | |
|---|---|---|---|---|
| 7,166,813 | B2 * | 1/2007 | Soma et al. | 200/600 |
| 7,250,581 | B2 * | 7/2007 | Asada | 200/341 |
| 2006/0180453 | A1 * | 8/2006 | Steidle et al. | 200/341 |

FOREIGN PATENT DOCUMENTS

JP 2007-173094 A 7/2007

* cited by examiner

*Primary Examiner* — Edwin A. Leon
(74) *Attorney, Agent, or Firm* — Canon USA Inc IP Division

(57) ABSTRACT

In an electronic apparatus, a first switch and a second switch are located in a correspondence relationship with each other. The first switch is configured to obtain an electric output by causing a first contact and a second contact to contact each other with an operation member. The second switch is configured to obtain an electric output by deforming a dome-shaped plate spring covering a third contact. The electronic apparatus includes a supporting member configured to keep a gap between the first contact and the second contact constant and to regulate the first switch and the second switch to be located on an approximately same line with respect to an operation direction of the operation member.

13 Claims, 6 Drawing Sheets

ELECTRONIC APPARATUS

BACKGROUND OF THE INVENTION

1. Field of the Invention

The present invention relates to an electronic apparatus and, more particularly, to an electronic apparatus including a two-step switch.

2. Description of the Related Art

Recently, according to downsizing/weight saving of electronic apparatuses, much more cost reduction demands have been greatly required. For example, in an imaging apparatus, such as a digital camera, a shooting button, i.e., a release switch, is generally configured to provide two-step outputs, which are obtained by a difference of the amount of pushing in a pushing direction. Output of the first step, which is a small amount of pushing, is used for starting automatic focusing, and output of the second step, which is a large amount of pushing, is used for starting a photographing operation. Until now, to advance downsizing of an imaging apparatus, a small-sized two-step switch mounted on a circuit board has been often used as a release switch.

On the other hand, there is another type release switch not using a mounting type switch but using a flexible property of a substrate. In this type release switch, output of the first step can be obtained by causing opposite contact portions of the flexible substrate to contact each other. Then, output of the second step can be obtained by causing a dome-shaped plate spring, which is stuck on the flexible substrate by an adhesive sheet, to contact a contact point on the flexible substrate. With such a configuration, a release switch having an inexpensive configuration can be obtained. However, when an exterior portion of the digital camera is made of not conductive metal but resin, there is an issue that static electricity may invade a contact portion of the flexible substrate from the periphery of the release switch, so that electric parts on the flexible substrate may be broken.

To address this issue, there is a release switch using a coil spring for pushing up a key-top, which is an operation portion, as a countermeasure of invading of static electricity. In this case, Japanese Patent Application Laid-Open No. 2007-173094 discusses a configuration in which an earth (ground) pattern is formed at a position surrounding the contact portion on the substrate and the coil spring can contact the earth pattern. According to the discussion in Japanese Patent Application Laid-Open No. 2007-173094, since static electricity invading from the periphery of the key-top flows to the coil spring, invasion of the static electricity can be prevented.

However, as described above, a reduction of size of an electronic apparatus, such as an imaging apparatus, has been an indispensable requirement. In the configuration discussed in Japanese Patent Application Laid-Open No. 2007-173094, a great number of parts are required and a degree of height corresponding to the configuration of the two-step switch is necessary, so that such configuration is not suitable for the reduction of size.

SUMMARY OF THE INVENTION

According to an aspect of the present invention, an electronic apparatus includes an operation member in which a convex portion is formed, a two-step switch including a first switch and a second switch, and a supporting member. The first switch is configured to obtain an electric output by causing a first contact and a second contact to contact each other with the convex portion, wherein the first contact and the second contact are located opposite each other via a first bent portion on a flexible substrate. The second switch is configured to obtain an electric output by deforming a dome-shaped plate spring covering a third contact on the flexible substrate to cause the dome-shaped plate spring and the third contact to contact each other. The first switch and the second switch are located in a correspondence relationship with each other via a second bent portion. The supporting member is configured to keep a gap between the first contact and the second contact constant, and to regulate the first switch and the second switch to be located on an approximately same line with respect to an operation direction of the operation member. The supporting member is made of a conductive material.

According to an exemplary embodiment of the present invention, an electronic apparatus in which static electricity hardly invades a contact portion can be provided without increasing the number of parts and the size of the apparatus.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
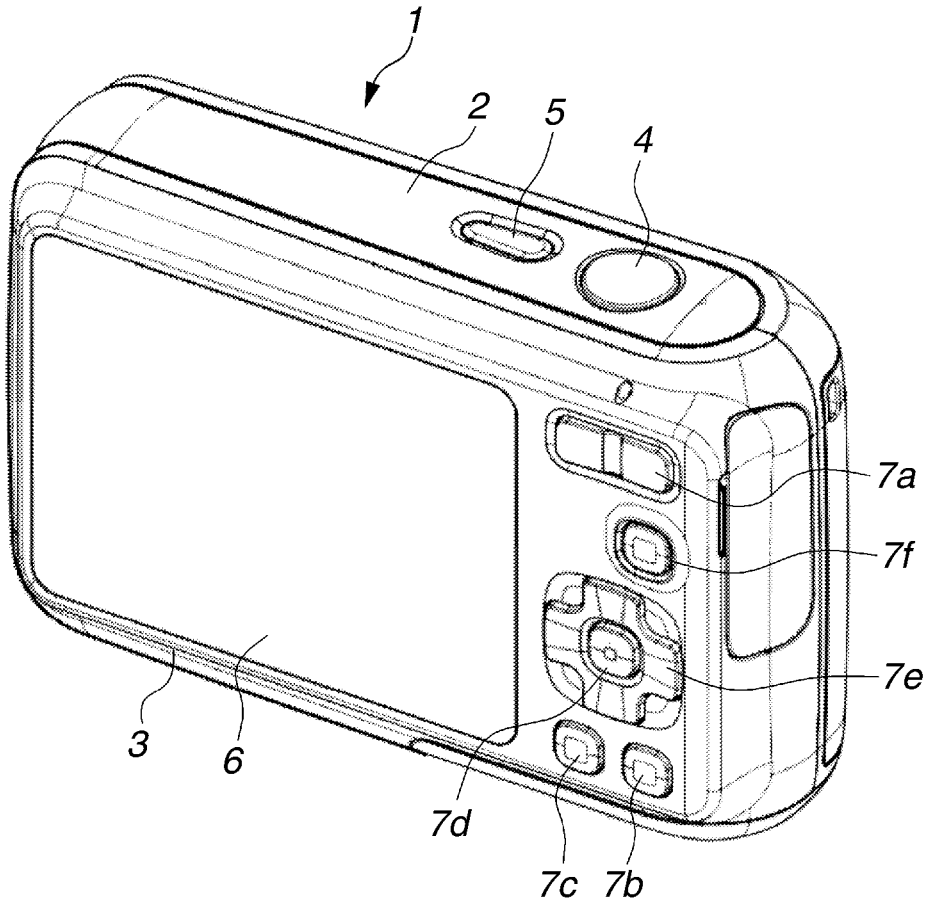
FIG. 1 is a perspective view of a digital camera according to an exemplary embodiment of the present invention.

FIG. 1 is a perspective view of a digital camera, which is an example of an imaging apparatus according to an exemplary embodiment of the present invention, as viewed from an operator side. A digital camera body 1 is covered with a front side exterior cover 2, constituting a front side and an upper surface of the digital camera body 1, and a back side exterior cover 3, constituting an operator (back) side. Operation members, such as a release button 4 and a power button 5, are located on the upper portion of the digital camera body 1. The release button 4 is an operation member for instructing starting of automatic focusing and photographing operation. The power button 5 is an operation member for ON/OFF switching of a power source of the digital camera. Particularly, the release button 4 is desirably located at an upper portion of the digital camera body 1 for easy operation by the index finger, when an operator holds the digital camera body 1 by the right hand. Further, in the present exemplary embodiment, the release button 4 and the power button 5 are held by the front side exterior cover 2, for making an inexpensive configuration. Further, the release button 4 has a two-step switch structure, which can detect two steps according to a pushing amount with respect to a pushing direction, for instructing starting of automatic focusing and photographing operation, respectively.

On the back surface of the digital camera 1, a display unit 6 and operation members 7*a* to 7*f* are located. The display unit 6 is used for confirming contents of a setting change of a possible range for photographing at the time of photographing or various kinds of photographing functions, or playback displaying of a photographed image. The operation members include a zoom button 7*a* for a zooming operation, a menu (MENU) button 7*b* for changing various settings, and a mode (MODE) button 7*c* for switching a photographing mode, such as still image photographing/moving image photographing. Furthermore, the operation members include a setting button 7*d* for determining selected contents, a selection button 7*e* for selecting a desired image from among a plurality of played-back images at the time of playback of photographed images, and a playback button 7*f* for directly switching to a playback display mode of a photographed image. These operation members 7*a* to 7*f* located on the backside surface of the digital camera body 1 are fixed to the back side exterior cover 3.

Figure 2:
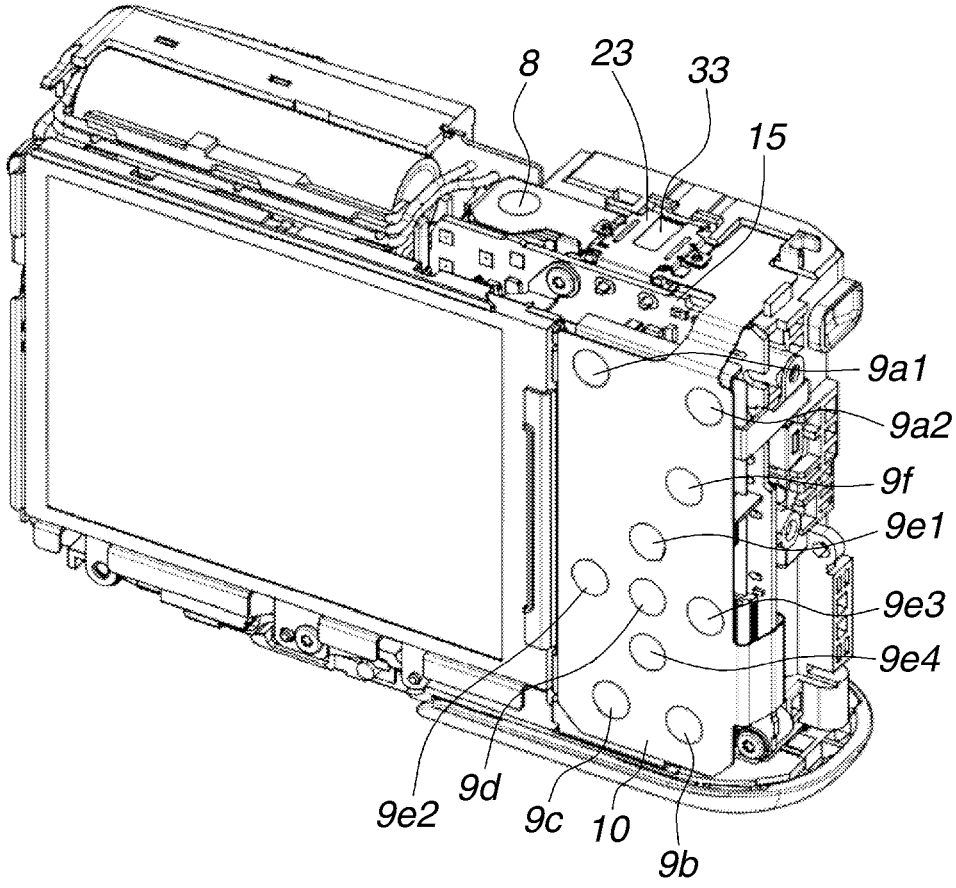
FIG. 2 is a perspective view illustrating a state obtained by removing an exterior of the digital camera according to the exemplary embodiment of the present invention.

FIG. 2 is a perspective view as viewed from the operator side when the exterior covers of the digital camera according to the present embodiment are removed. A flexible substrate 10 is continuously located on an upper surface and a back surface of the digital camera body 1. A metal dome 8 for detecting an operation of the power button 5 located on the digital camera body 1 is fixed on the flexible substrate 10. Further, metal domes 9*a*1, 9*a*2, 9*b*, 9*c*, 9*d*, 9*e*1-*e*4, and 9*f* for detecting operations of the operation members 7*a* to 7*f* located on the back surface are fixed on the flexible substrate 10 by adhesive sheets 11, which are not illustrated in FIG. 2 (refer to FIG. 4). A first contact 12 and a second contact 13 (refer to FIG. 3A) for detecting a first step operation, which is used for starting automatic focusing, are formed on the flexible substrate 10. The flexible substrate 10 is bent at a first bent portion 19, and then bent again at a second bent portion 18. A part from the top end of the flexible substrate 10 to the first bent portion 19 is referred to as a first folded portion 21, a part from the first bent portion 19 to the second bent portion 18 is referred to as a second folded portion 20, and a part from the second bent portion 18 to a portion contacting a battery storage unit 16 is referred to as a base portion 22. The first contact 12 is provided at the second folded portion 20, the second contact 13 is provided at the first folded portion 21, and a third contact 37 and a metal dome 14 covering the third contact 37 are provided at the base portion 22. The first folded portion 21 and the second folded portion 20 are located so as to make the first contact 12 and the second contact 13 opposite each other above the metal dome 14.

The metal dome 14 (a dome-shaped plate spring), which detects a second step operation used for instructing starting of a photographing operation, is fixed on the flexible substrate 12 by the adhesive sheet 11 similarly to the metal domes for detecting other operation members. With such a configuration, in which a two-step switch is constituted with only one metal dome and contact portions, a two-step switch structure can be made inexpensive than a mounting type two-step switch. Further, the flexible substrate 10 is connected to a circuit board 15 by a connector (not illustrated).

Figure 3A:
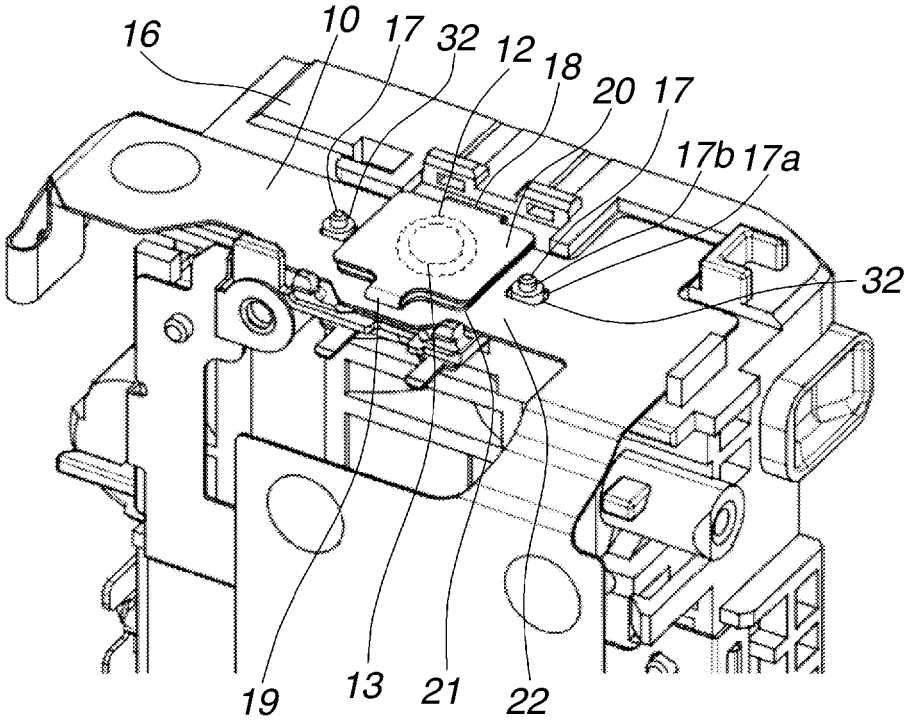
FIG. 3A is a perspective view of a two-step switch portion according to the exemplary embodiment of the present invention.
Figure 3B:
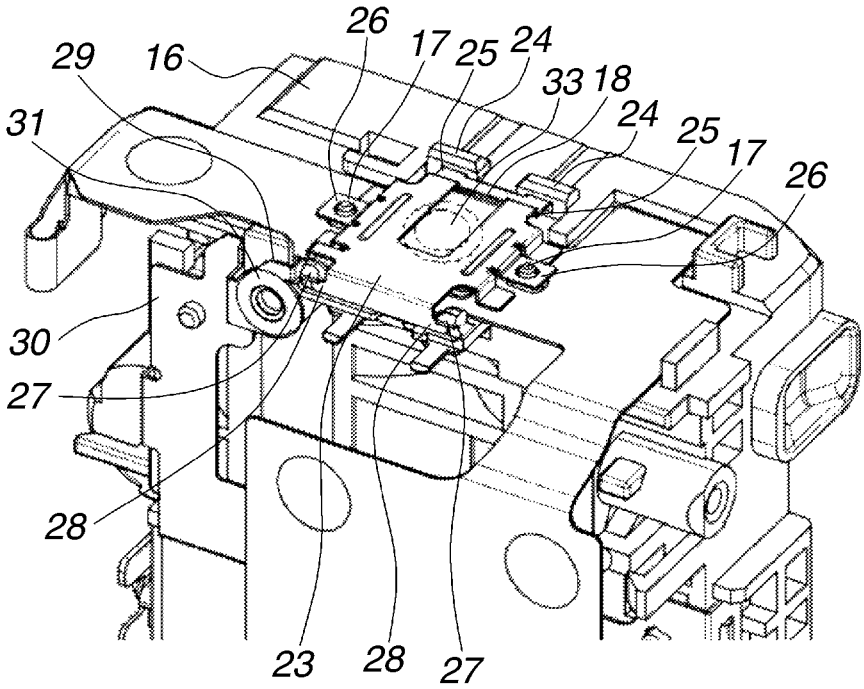
FIG. 3B is a perspective view of the two-step switch portion according to the exemplary embodiment of the present invention.
Figure 4:
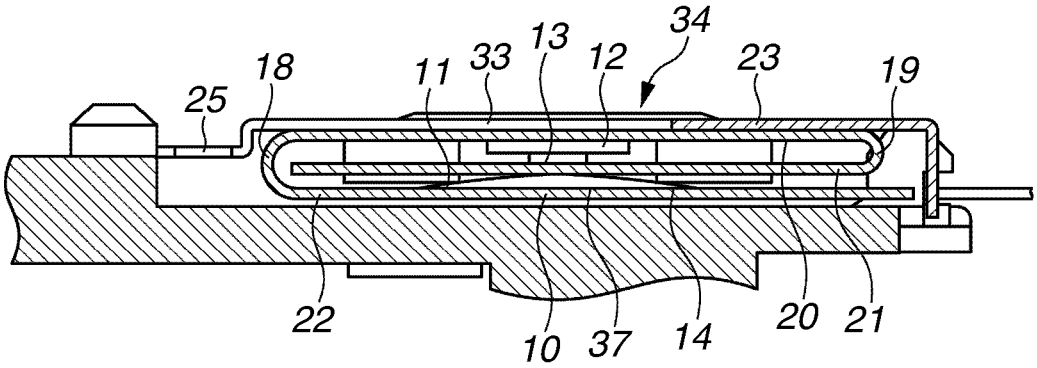
FIG. 4 is a cross-sectional view of the two-step switch portion according to the exemplary embodiment of the present invention.

FIGS. 3A and 3B are enlarged perspective views of the two-step switch portion according to the present exemplary embodiment. FIG. 4 is a cross sectional view of the two-step switch portion. The flexible substrate 10 is positioned with a positioning boss 17, protruding from the battery storage unit 16 at the neighborhood of the two-step switch portion, inserted in a hole 32 provided in the flexible substrate 10. Further, a supporting member 23 is positioned with the positioning boss 17 inserted in a hole 26 provided in the supporting member 23. The positioning boss 17 is a stepped boss, whose diameter changes at the middle portion, in which a thick diameter portion 17*a* is used to position the flexible substrate 10 and a thin diameter portion 17*b* is used to position the supporting member 23. Locating the supporting member 23 to the portion in which the diameter of the positioning boss 17 is changed enables a gap between the supporting member 23 and the flexible substrate 10 to be kept constant.

In the two-step switch portion, the flexible substrate 10 is bent at the first bent portion 19, and then bent again at the second bent portion 18. With this structure, the first contact 12 provided at the second folded portion 20 and the second contact 13 provided at the first folded portion 21 are located opposite each other. In addition, a gap between the first contact 12 and the second contact 13 is kept constant by the supporting member 23. On the base portion 22, the third contact 37 is located. The metal dome 14 for detecting the second step operation is fixed above the third contact 37 by the adhesive sheet 11

With the aforementioned structure, when a load is applied from above by the release button 4, the second folded portion 20 of the flexible substrate 10 moves downward. Then, the first contact 12 contacts the second contact 13 provided at the first folded portion 21 to obtain, as the first switch, an electric output for instructing starting of automatic focusing. Further, when the load increases more, the second folded portion 20 and the first folded portion 21 move downward together and deform the metal dome 14 fixed on the base portion 22. When the metal dome 14 is deformed more than a predetermined amount, the metal dome 14 contacts the third contact 37 provided on the base portion 22 to obtain, as the second switch, an electric output for instructing starting of photographing operation. In this structure, the first switch and the second switch are located in a correspondence relationship with each other via the second bent portion 18. Furthermore, the first switch and the second switch are regulated so as to be located on an approximately same line with respect to an operation direction of the release button 4, which is an operation member.

After the flexible substrate 10 is bent at the first bent portion 19 and the second bent portion 18, the flexible substrate 10 is held down by the supporting member 23 to prevent the flexible substrate 10 to move up due to restoring force (stiffness) of the first bent portion 18 and the second bent portion 19. Thus, the supporting member 23 is fixed at the battery storage unit 16 so as to hold down the flexible substrate 10 from above in the state that the flexible substrate 10 is bent. At first, a projection portion 25 provided in the supporting member 23 is inserted in a hole 24 provided in the battery storage portion 16 and the positioning boss 17 is inserted in a hole 26 provided in the supporting member 23. Further, a hook portion 28 of the supporting member 23 is fixed at a claw portion 27 provided in the battery storage unit 16, so that the supporting member 23 is completely positioned and fixed at the battery storage unit 16. The supporting member 23 includes a ground connection portion 29. The ground connection portion 29 is fixed to a ground pattern portion (not illustrated) of the circuit board 15 with a screw via a ground plate 30 and a screw fitting portion 31 of the ground plate 30, so that the supporting member 23 is electrically connected to the ground pattern portion of the circuit board 15. The supporting member 23 is made of a conductive material, for example, a metal such as a stainless steel. Accordingly, the whole supporting member 23 can be made thin and can be electrically connected to the ground plate 30.

Figure 5:
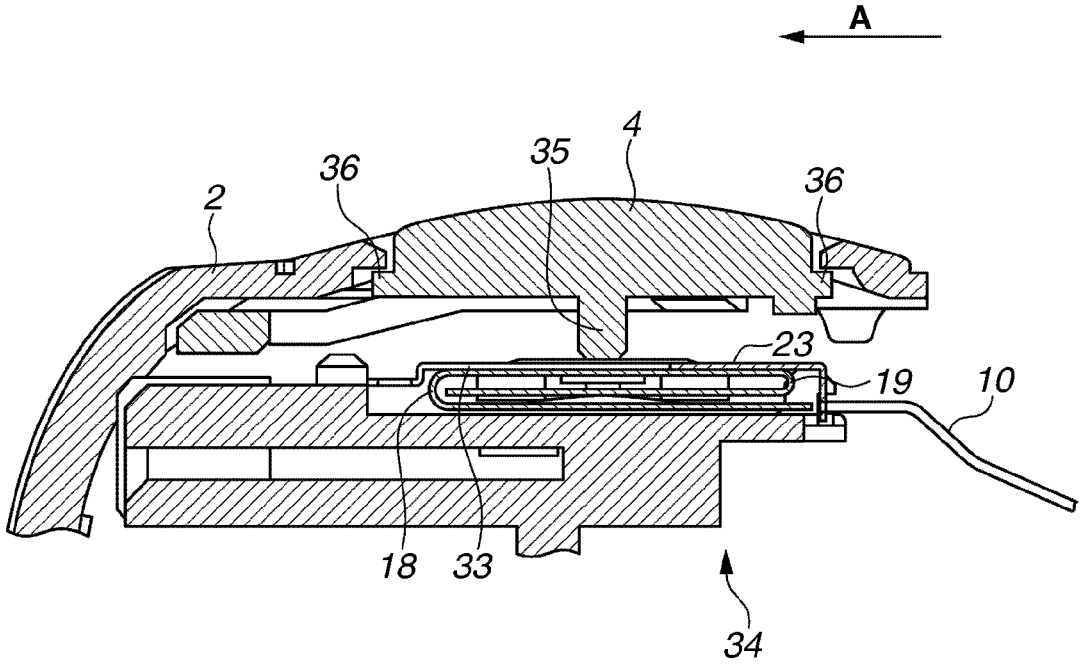
FIG. 5 is a cross-sectional view of the two-step switch portion according to the exemplary embodiment of the present invention.

FIG. 5 is a cross-sectional view of the two-step switch portion according to the present exemplary embodiment. A unit 34 in which the flexible substrate 10 and the supporting member 23 are fixed on the battery storage unit 16 is incorporated in the front side exterior cover 2, to which the release button 4 is fixed, in a direction A, which is approximately parallel with an optical axis. A cutout portion 33 is formed at the supporting member 23 to avoid, at the time of incorporation, an interference with a pusher portion 35, which is formed in a convex shape, of the release button 4 (refer also to FIG. 3B). By providing the cutout portion 33, the whole of the two-step switch portion can be made thinner. Further, the release button 4 includes a flange portion 36. When the release button 4 is not operated, the flange portion 36 contacts the front side exterior cover 2. With this structure, the release button 4 is held by the front side exterior cover 2. Further, the flange portion 36 has appearance and structural roles for preventing viewing of an interior of the digital camera body 1 and invading of dusts. The flange portion 36 has a smaller size than the supporting member 23, so that when static electricity invades around the release button 4, the flange portion 36 realizes a role for guiding static electricity to the supporting member 23 before the static electricity enters the first contact 12 and the second contact 13. Since the supporting member 23 is electrically connected to the ground plate 30, static electricity can be prevented from flowing into the circuit board 15.

Further, at the neighborhood of the cutout portion 33, an invading route of static electricity from the second folded portion 18 of the flexible substrate 10 to the first contact 12 and the second contact 13 is closed, and the static electricity flows to the supporting member 23 rather than flowing into the circuit board 15. Therefore, it is useful that a cutout width of the cutout portion 33 is set to be smaller than a width of the second bent portion 18. With such a structure, when the unit 34 is incorporated in the front side exterior cover 2, the pusher portion 35 can be prevented from bending up the flexible substrate 10. In the present exemplary embodiment, since the pusher portion 35 of the release button 4 enters the cutout portion 33 from the second bent portion 18 side, the pusher portion 35 does not bend up the flexible substrate 10. More specifically, in the first bent portion 19 side, since the first bent portion 19 and base portion 22 are overlapped, the pusher portion 35 may bend up the first bent portion 19 when the pusher portion 35 enters the cutout portion 33 from the first bent portion 19 side. However, in the second bent portion 18 side, such a thing does not occur. Further, in the present exemplary embodiment, the digital camera has a configuration in which the unit 34 is incorporated in the front side exterior cover 2 along the optical axis. Therefore, the cutout portion 33 is required in the supporting member 23. However, when the digital camera has a configuration in which the unit 34 is incorporated in the front side exterior cover 2 along a direction of pushing of the release button 4, the configuration of the two-step switch portion can be made available by using only a hole provided to allow the pusher portion 35 of the release button 4 to push the flexible substrate 10. With such a configuration, the digital camera becomes more effective against invasion of static electricity.

With the aforementioned configuration, it becomes possible to configure a two-step switch, such as a release switch, at a low cost and with a thin structure, and to prevent a fault in which static electricity invades a circuit board through a contact to break elements.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-291468 filed Dec. 22, 2009, which is hereby incorporated by reference herein in its entirety.

What is claimed is:

1. An electronic apparatus comprising:

an operation member in which a convex portion is formed;

a two-step switch including a first switch and a second switch, the first switch being configured to obtain an electric output by causing a first contact and a second contact to contact each other with the convex portion, the first contact and the second contact being located opposite each other via a first bent portion on a flexible substrate, the second switch being configured to obtain an electric output by deforming a dome-shaped plate spring covering a third contact on the flexible substrate to cause the dome-shaped plate spring and the third contact to contact each other, the first switch and the second switch being located in a correspondence relationship with each other via a second bent portion on the flexible substrate; and a supporting member configured to keep a gap between the first contact and the second contact constant, and to regulate the first switch and the second switch to be located on an approximately same line with respect to an operation direction of the operation member, wherein the supporting member is made of a conductive material.

2. The electric apparatus according to claim 1, further comprising:

a cutout portion formed in the supporting member, wherein the cutout portion is formed to prevent interference of the convex portion with the supporting member, when the flexible substrate fixed by the supporting member and the operation member are incorporated into the electronic apparatus.

3. The electronic apparatus according to claim 1, further comprising:

an exterior member configured to hold the operation member; and a flange portion formed in the operation member, wherein the flange portion contacts the exterior member when the operation member is not operated.

4. The electronic apparatus according to claim 3, wherein the supporting member is formed to have an area larger than a projected area of the flange portion.

5. The electronic apparatus according to claim 4, wherein the cutout portion is formed to have an area smaller than a projected area of the flange portion.

6. The electronic apparatus according to claim 5, wherein a width of the second bent portion provided on the flexible substrate is formed to be larger than a width of the cutout portion.

7. An electronic apparatus comprising:

an operation member which is operated by a user;

a flexible substrate including a first bent portion, a second bent portion, a first contact, a second contact, a third contact and a dome-shaped plate spring covering the third contact; and a supporting member which supports the flexible substrate of which the first bent portion and the second bent portion are bent, wherein the first contact and the second contact are located opposite each other by bending the flexible substrate at the first bent portion, wherein the first contact, the second contact and the dome-shaped plate spring are located on an approximately same line with respect to an operation direction of the operation member by bending the flexible substrate at the second bent portion, and wherein the supporting member supports the flexible substrate so that the first contact and the second contact do not contact each other when the operation member is not operated.

8. The electronic apparatus according to claim 7, wherein the supporting member is made of a conductive material.

9. The electronic apparatus according to claim 7, wherein the operation member has a convex portion, and wherein the supporting member has a cutout portion to prevent interference of the convex portion with the supporting member, when the flexible substrate fixed by the supporting member and the operation member are incorporated into the electronic apparatus.

10. The electronic apparatus according to claim 7, further comprising:

an exterior member configured to hold the operation member; and a flange portion formed in the operation member, wherein the flange portion contacts the exterior member when the operation member is not operated.

11. The electronic apparatus according to claim 10, wherein the supporting member is formed to have an area larger than a projected area of the flange portion.

12. The electronic apparatus according to claim 11, wherein the cutout portion is formed to have an area smaller than a projected area of the flange portion.

13. The electronic apparatus according to claim 12, wherein a width of the second bent portion provided on the flexible substrate is formed to be larger than a width of the cutout portion.

* * * * *